US008622788B2

(12) United States Patent
Eto et al.

(10) Patent No.: US 8,622,788 B2
(45) Date of Patent: Jan. 7, 2014

(54) DUST COLLECTING COVER

(75) Inventors: Naoya Eto, Niigata (JP); Yoshimi Takahashi, Kanagawa (JP)

(73) Assignees: Nakaya Co., Ltd., Niigata (JP); Sankyo Diamond Industrial Co., Ltd., Kanagawa (JP)

( * ) Notice: Subject to any disclaimer, the term of this patent is extended or adjusted under 35 U.S.C. 154(b) by 52 days.

(21) Appl. No.: 12/935,106

(22) PCT Filed: Dec. 8, 2009

(86) PCT No.: PCT/JP2009/070522

§ 371 (c)(1),
(2), (4) Date: Sep. 28, 2010

(87) PCT Pub. No.: WO2010/087072

PCT Pub. Date: Aug. 5, 2010

(65) Prior Publication Data

US 2011/0275293 A1 Nov. 10, 2011

(51) Int. Cl.
*B24B 55/04* (2006.01)

(52) U.S. Cl.
USPC ..... 451/451; 451/359; 451/456

(58) Field of Classification Search
USPC ..... 451/353, 359, 451, 453, 456
See application file for complete search history.

(56) References Cited

U.S. PATENT DOCUMENTS

| | | | | |
|---|---|---|---|---|
| 6,699,114 | B1 * | 3/2004 | Booeshaghi et al. | 451/451 |
| 8,133,094 | B2 * | 3/2012 | Loveless et al. | 451/28 |
| 8,137,165 | B2 * | 3/2012 | Loveless et al. | 451/456 |
| 2007/0178815 | A1 | 8/2007 | Buser | |
| 2009/0181605 | A1 * | 7/2009 | Loveless et al. | 451/456 |
| 2009/0186559 | A1 * | 7/2009 | Loveless et al. | 451/28 |
| 2011/0021121 | A1 * | 1/2011 | Loveless et al. | 451/456 |

FOREIGN PATENT DOCUMENTS

| | | | |
|---|---|---|---|
| JP | 07-11258 | U | 2/1995 |
| JP | 10-264027 | A | 10/1998 |
| JP | 10-277907 | A | 10/1998 |
| JP | 10-315134 | | 12/1998 |
| JP | 2005-238417 | | 9/2005 |
| JP | 2005-288566 | A | 10/2005 |
| JP | 2008-049469 | | 3/2008 |
| JP | 2008-307643 | | 12/2008 |
| JP | 2009-172696 | A | 8/2009 |

* cited by examiner

*Primary Examiner* — Eileen P. Morgan

(74) *Attorney, Agent, or Firm* — Kubotera & Associates, LLC

(57) ABSTRACT

An object of the present invention is to provide a dust collecting cover for a grinding cup wheel having both excellent practicality and versatility.

A base plate is joined to a body of the dust collecting cover via elastic bodies at a plurality of positions, an adapter for joining an angle grinder is attachably/detachably provided on the base plate, and a portion of the body cover is formed as a sub-cover openable/closable utilizing a magnetic force of a magnet, and the sub-cover is configured to be fastenable to the body cover by a screw inserted via a through hole provided in the magnet into a female screw part provided on the body cover side.

8 Claims, 3 Drawing Sheets

DUST COLLECTING COVER

TECHNICAL FIELD

The present invention relates to a dust collecting cover used for preventing scattering of and collecting dust generated in grinding work performed mainly using an angle grinder.

BACKGROUND ART

During the grinding work of concrete and the like, generation of dust is inevitable, and various methods have been devised so far to prevent scattering of and collect the dust.

Most of them are of the kind in which a cup-shaped cover covering a grinding cup wheel rotationally driven by using an electric tool such as an angle grinder and a vacuum cleaner is connected to a duct provided at a portion of the cover to collect the dust inside the cover using the suction force of the vacuum cleaner.

Among them, the dust collecting cover introduced in Japanese Patent Laid-open Publication No. 2008-049469 employs the method of connecting an angle grinder to an adapter that is joined to a body cover by a plurality of springs, so that the worker can freely move a head part of the angle grinder and therefore perform finer grinding work. Further, a sub-cover provided at a portion of the body cover is also openable/closable utilizing a magnetic force of magnets, so that the dust collecting cover has a structure allowing even the grinding work close to a wall.

However, since various kinds of angle grinders which are used in the actual sites of work widely vary in shape, it is impossible to design the aforesaid adapter to be commonly used for all of the angle grinders.

Accordingly, for versatility, it is necessary to prepare dedicated adapters matching the respective shapes of the angle grinders. However, with the configuration of the above-described dust collecting cover, all of the springs need to be detached using a special tool such as pliers or the like for replacement of the adapter, thus forcing the worker to perform a difficult and complex work.

Furthermore, the above-described sub-cover, which opens/closes utilizing the magnetic force of the magnets, is not always attached to the body cover by an absolute binding force. Therefore, when the surface of a material to be ground is very coarse and has many steps, the worker has to perform the is grinding work paying close attention not to detach the sub-cover during the work.

The other devised dust collecting covers have problems in the structure, usability, and the dust collecting performance as described in Japanese Patent Laid-open Publication No. 2008-049469, and any of them is far from perfect.

PRIOR ART DOCUMENT

Patent Document

Patent Document 1: Japanese Patent Laid-open Publication No. 2008-049469

DISCLOSURE OF THE INVENTION

Problems to be Solved by the Invention

An effective measure of preventing scattering of the dust generated during the grinding work is that the grinding cup wheel is covered with a cover, and a vacuum cleaner is connected to a duct provided on the cover to suck the dust in the cover. However, the above-described angle grinders are of various types and their shapes are not uniform, and it is difficult to give versatility to them.

Further, there is another method of making a portion of the cover openable/closable to enable the grinding work to an extent close to a wall, but the portion needs to be the one whose open/close movement can be easily performed and which is not unintentionally opened during the work.

An object of the present invention is to provide a dust collecting cover for a grinding cup wheel having both excellent practicality and versatility.

Means for Solving the Problems

The above object is achieved by joining a base plate to a body of a dust collecting cover via elastic bodies at a plurality of positions, providing an adapter for joining an angle grinder to be attachable/detachable on the base plate, and forming a portion of the body cover as a sub-cover openable/closable utilizing a magnetic force of a magnet to configure the sub-cover to be fastenable to the body cover by a screw inserted via a through hole provided in the magnet into a female screw part provided on the body cover side.

Effect of the Invention

The dust collecting cover according to the present invention has a structure in which an adapter used for connection with an angle grinder can be easily replaced with another by a commonly-used tool, so that the dust collecting cover can be widely used for various angle grinders by replacement of adapters prepared for the respective angle grinders.

In addition, the dust collecting cover not only employs the easily-handled magnet attraction method but also is structured to be completely fixable with screws, so that stable grinding work can be performed even under conditions that a load is applied on the sub-cover.

BEST MODE FOR CARRYING OUT THE INVENTION

Figure 1:
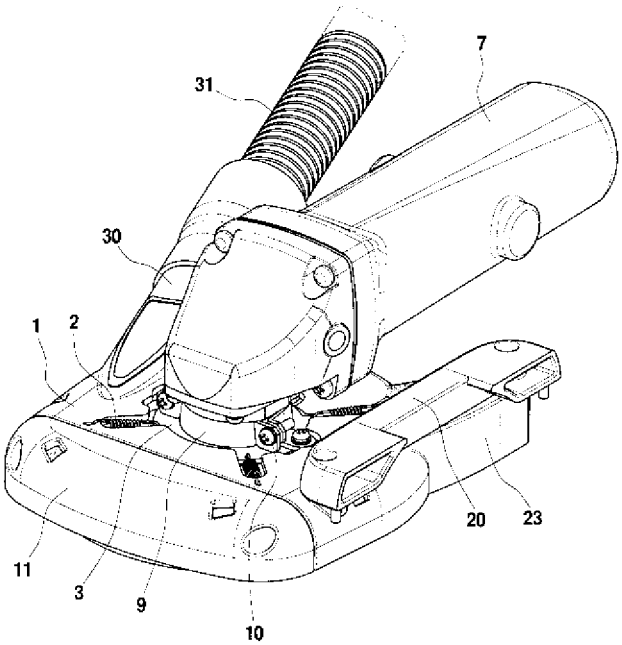
FIG. 1 A perspective view illustrating an embodiment of a dust collecting cover according to the present invention.
Figure 2:
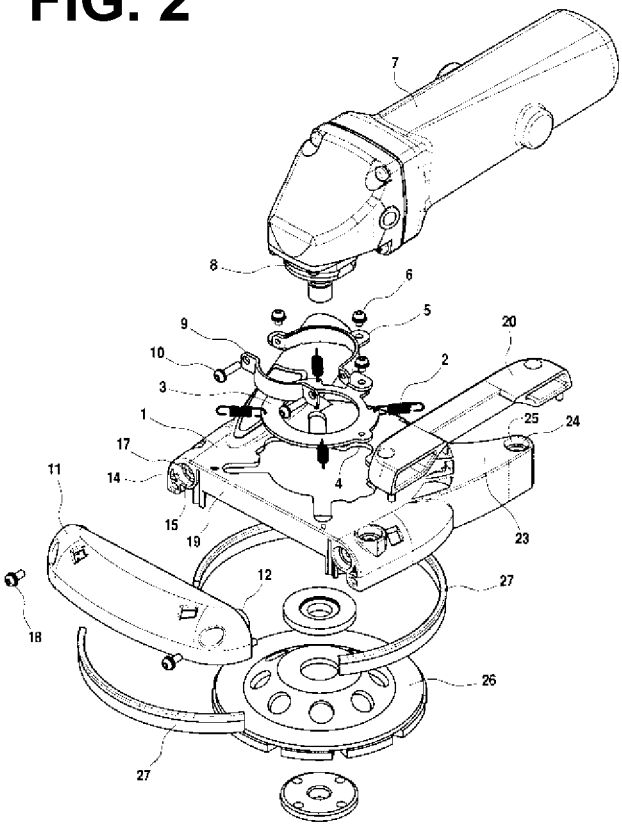
FIG. 2 An exploded perspective view of FIG. 1.

A dust collecting cover according to the present invention is configured such that a base plate 3 is joined to a body cover 1 via springs 2 at a plurality of positions as illustrated in FIG. 1. Female screws 4 are provided, as illustrated in FIG. 2, in the base plate 3 to which a first adapter 5 as a separate component is fixed by screws 6.

A gear case part 8 of an angle grinder 7 is placed on the first adapter 5 and a second adapter 9 is fastened to the first adapter 5 with screws 10, whereby the angle grinder 7 can be joined to the body cover 1.

The body cover 1 is configured to be open at a portion to which a separate sub-cover 11 is attached.

Figure 3:
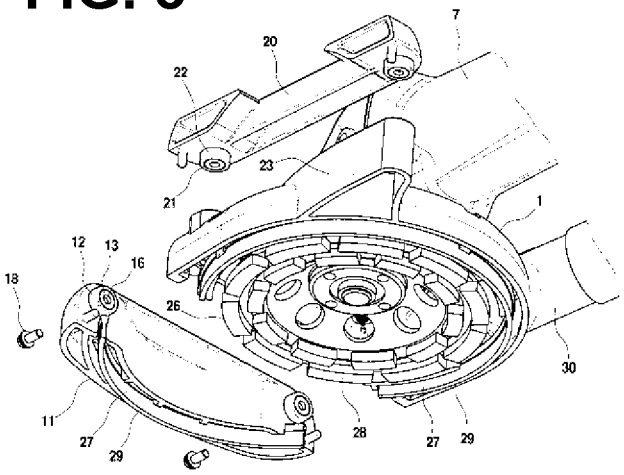
FIG. 3 A partially exploded perspective view of FIG. 1 seen from another angle.

As illustrated in FIG. 3, magnets 13 are adhered to the tips of protruding-shape parts 12 on the sub-cover 11 side, recessed-shape parts 14, which are matched with the positions and the shapes of the protruding-shape parts 12, are provided on the body cover 1 side, and bushings 15 made of iron are casted in the bottom faces of the recessed-shape parts 14. Accordingly, only by bringing the sub-cover 11 into abutment with the body cover 1, the sub-cover 11 can be attached to the body cover 1 side by the attraction force of the magnets 13.

Further, the magnets 13 are machined to have through holes 16 and the bushings 15 are machined to have female screws 17 so that screws 18 can be inserted into the through holes 16 of the magnets 13 from the sub-cover 11 side and fastened to the female screws 17 of the bushings 15.

For an open face 19 of the body cover 1, a plate 20 that is attachable thereto is prepared separately from the sub-cover 11 and also has protruding-shape parts 22, similar to those of the sub-cover 11, having magnets with through hole 21 adhered to the tips thereof.

A pedestal 23 is provided on a side face of the body cover 1, and recessed-shape parts 25 having bushings with female screw 24 casted therein are provided on the pedestal 23 similarly to the open face 19 so that the sub-cover 11 and the plate 20 can be similarly attached to the pedestal 23.

When a grinding cup wheel 26 is attached to the angle grinder 7, the body cover 1 and the sub-cover 11 come to cover the grinding cup wheel 26. Note that blushes 27 are attached to the lower end faces of the body cover 1 and the sub-cover 11 and configured such that a lower end face 28 of the grinding cup wheel 26 is slightly retracted to the inside of the cover behind lower end faces 29 of the blushes 27.

At the body cover 1, a duct 30 leading from the inside of the body cover 1 is provided, and a hose 31 can be attached to the duct 30 and connected to a not-shown vacuum cleaner.

Since the shape of the angle grinder 7 varies from manufacturer to manufacturer as described above, when another angle grinder is newly attached, it is necessary to replace the adapter with a dedicated adapter.

Figure 4:
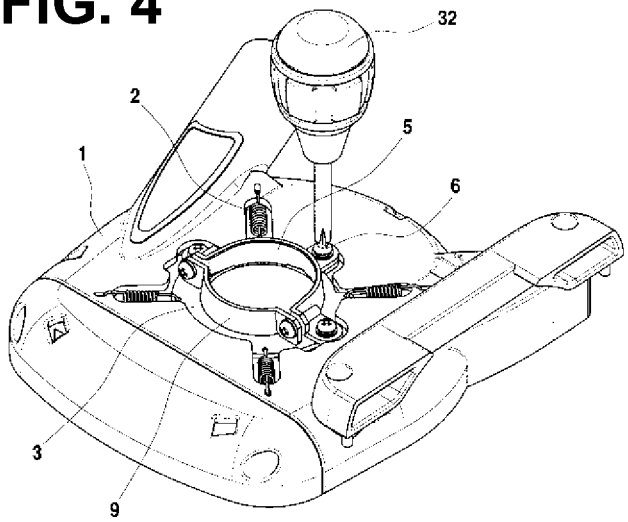
FIG. 4 A perspective view illustrating an image when an adapter is replaced.

Even such a situation can be easily dealt with in the dust collecting cover according to the present invention only by detaching the screws 6 using an ordinary tool 32 as illustrated in FIG. 4 and attaching another adapter in the reverse order.

Since the base plate 3 itself is in a stable state during the adapter replacement, a worker never worries about the influence of the springs 2, unlike the above-described conventional product.

After turning on the power of the angle grinder 7 to drive the grinding cup wheel 26, the worker first brings the blushes 27 into contact with a material to be ground and then gradually presses the angle grinder 7 downward, whereby the lower end face 28 of the grinding cup wheel 26 finally comes into contact with the material to be ground and the worker can start the grinding work.

Since the blushes 27 are provided all around a space between the material to be ground and the cover, dust generated by the grinding rarely escapes from the lower end portion of the cover and will be blown and gathered inside the cover. By connecting the vacuum cleaner to the duct 30 for suction in this event, it becomes possible to collect most of the dust.

Figure 5:
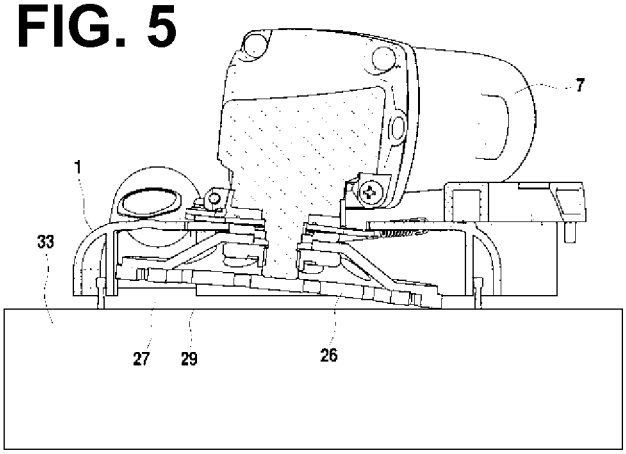
FIG. 5 A sectional view illustrating a status of use of the dust collecting cover according to the present invention.

In the actual grinding work, not only surface grinding but also local grinding through use of an edge portion of the grinding cup wheel 26 by inclining the grinding cup wheel 26 are required in many case. The dust collecting cover according to the present invention has a spring-holding structure in which the adapter part is freely movable, so that the grinding cup wheel 26 can be inclined inside the cover without separating the blushes 27 from a material to be ground 33 as illustrated in FIG. 5, thus never deteriorating the dust collecting efficiency even during such a specific use.

Further, the first adapter 5 and the second adapter 9 and the base plate 3 being the base of them are molded products made of a steel sheet and therefore have high durability to withstand the load, fall and the like in use.

Further, even if there are some steps and the like on the surface of the material to be ground 33, the blushes 27 flexibly cope with the steps and the like and can therefore minimize catch during the work and escape of dust. Even when the blushes 27 are damaged due to repeated use over the years, it is possible to detach only the blushes 27 and replace them with other ones.

When the surface of the material to be ground 33 is very coarse and has many steps, the blushes 27 are likely to be caught by the steps. However, the screws 18 absolutely fix the sub-cover 11 under such bad conditions to eliminate the fear of unintentional dropout of the sub-cover 11.

As a matter of course, when the surface of the material to be ground 33 is relatively flat and free from conspicuous steps, the sub-cover 11 can be attached only by the attraction force of the magnets 13 as usual for the grinding work.

Figure 6:
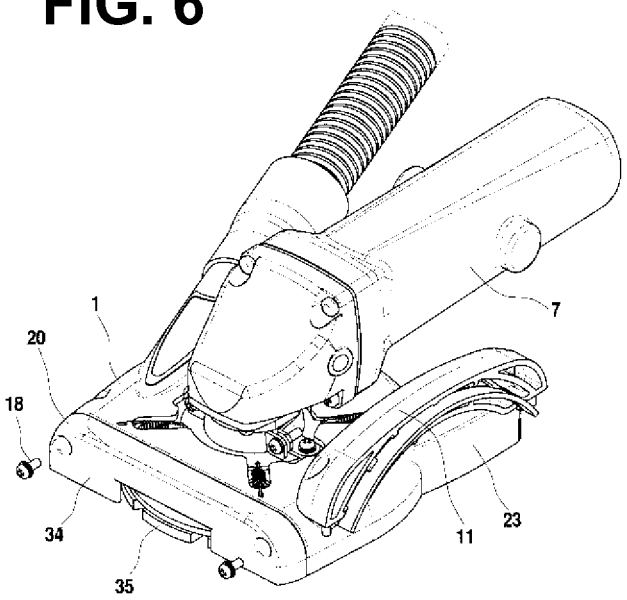
FIG. 6 A perspective view illustrating another embodiment of the dust collecting cover according to the present invention.

On the other hand, when the sub-cover 11 is replaced with the plate 20, a grinding cup wheel side face 35 is slightly exposed from a plate face 34 as illustrated in FIG. 6. Therefore, by performing the work while keeping the plate face 34 in abutment with the wall surface, the worker can perform the grinding as close as possible to the wall.

Basically, a load is unlikely to be applied in a direction in which the plate 20 is detached in the grinding work close to the wall, and it is also possible to completely fix the plate 20 to the body cover 1 with the screws 18 as necessary, similarly to the sub-cover 11.

Note that the plate 20 is unnecessary during the normal grinding work, whereas the sub-cover 11 is unnecessary during the grinding close to the wall. Each of the plate 20 and the sub-cover 11 can be easily attached to the pedestal 23 on the side face of the body cover 1 utilizing the attraction force of the magnets 13 as illustrated in FIG. 1 and FIG. 6, so that missing of them can be prevented.

Further, when the body cover 1 and the sub-cover 11 are made of a transparent material, the worker can visually grasp the approximate position of the grinding cup wheel 26 inside them during the work.

In the actual use, the insides of both the body cover 1 and the sub-cover 11 are likely to be slightly obscure by the dust, but the transparent material is effective means for the worker who wants to intuitively grasp the position of the grinding cup wheel 26.

INDUSTRIAL AVAILABILITY

The present invention can be used for preventing scattering of and collecting dust generated in grinding work performed mainly using an angle grinder.

EXPLANATION OF CODES

1 body cover
2 spring
3 base plate
4 female screw

5 first adapter
6 screw
7 angle grinder
8 gear case part
9 second adapter
10 screw
11 sub-cover
12 protruding-shape part
13 magnet
14 recessed-shape part
15 bushing
16 through hole
17 female screw
18 screw
19 open face
20 plate
21 magnet with through hole
22 protruding-shape part
23 pedestal
24 bushing with female screw
25 recessed-shape part
26 grinding cup wheel
27 blush
28 lower end face
29 lower end face
30 duct
31 hose
32 tool
33 material to be ground
34 plate face
35 cup wheel side face

The invention claimed is:

1. A dust collecting cover for preventing scattering of and collecting dust generated by a power tool assembly during a grinding operation, said dust collecting cover being formed to cover a grinding toot having a spindle that is rotationally driven by a motor of the power tool assembly during the grinding operation, comprising:

a body cover to be surrounding the grinding tool, a duct disposed on the body cover for joining to a vacuum cleaner to suck the dust during the grinding operation, a base plate joined to the body cover via elastic bodies at a plurality of positions, said elastic bodies extending substantially perpendicular to the spindle when the dust collecting cover is attached to the power tool assembly, and an adapter attached to the base plate with a first screw so that the adapter can connect the body cover to the power tool assembly.

2. The dust collecting cover according to claim 1, further comprising a sub-cover attached to the body cover through a magnetic force of a magnet, said sub-cover being fixed to said body cover by a second screw inserted via a through hole provided in said magnet into a female screw part provided on said body cover.

3. The dust collecting cover according to claim 2, wherein said body cover and said sub-cover are made of a transparent material.

4. The dust collecting cover according to claim 1, wherein said adapter includes a first adapter member and a second adapter member connected to the first adapter member with a bolt.

5. The dust collecting cover according to claim 1, wherein said base plate is formed of one single plate member.

6. The dust collecting cover according to claim 1, wherein said body cover includes an opening portion at a center thereof for receiving the adapter.

7. The dust collecting cover according to claim 4, wherein said first adapter member includes a screw hole for inserting the first screw and said second adapter member does not have the screw hole.

8. The dust collecting cover according to claim 6, wherein said opening portion can receive differently sized adapters to attach to the power tool assembly.

* * * * *